US005752981A

United States Patent [19]

Fornelli

[11] Patent Number: 5,752,981

[45] Date of Patent: May 19, 1998

[54] FINISHING OF TEXTILE FIBRE MATERIALS

[75] Inventor: Saverio Fornelli, Basle, Switzerland

[73] Assignee: Clariant Finance (BVI) Limited, Tortola, Virgin Islands (Br.)

[21] Appl. No.: 766,436

[22] Filed: Dec. 9, 1996

Related U.S. Application Data

[63] Continuation of Ser. No. 382,334, Feb. 1, 1995, abandoned.

[30] Foreign Application Priority Data

Feb. 3, 1994 [DE] Germany ..... 44 03 305.2

[51] Int. Cl.[6] ..... D06M 10/06; C11D 3/14

[52] U.S. Cl. ..... 8/137; 8/139; 8/125; 8/115.51; 8/102; 8/107; 8/138; 252/8.63; 252/8.83; 252/8.91; 252/8.84; 252/8.85; 510/320; 510/322; 510/323; 510/327; 510/276

[58] Field of Search ..... 8/137, 139, 125, 8/115.51, 102, 107, 138; 252/8.63, 8.83, 8.91, 8.84, 8.85; 510/320, 322, 323, 327, 276

[56] References Cited

U.S. PATENT DOCUMENTS

| | | | |
|---|---|---|---|
| 3,281,367 | 10/1966 | Jones et al. | 510/397 |
| 3,986,824 | 10/1976 | Walbel et al. . | |
| 4,051,046 | 9/1977 | Diehl et al. | 8/137 |
| 4,076,633 | 2/1978 | Edwards et al. | 510/516 |
| 4,287,080 | 9/1981 | Siklosi | 510/235 |
| 4,500,320 | 2/1985 | Grunert | 8/442 |
| 4,575,887 | 3/1986 | Viramontes | 8/158 |
| 4,738,682 | 4/1988 | Boegh et al. | 8/401 |
| 4,800,038 | 1/1989 | Broze et al. | 510/303 |
| 4,832,864 | 5/1989 | Olson | 8/401 |
| 4,900,323 | 2/1990 | Dickson et al. | 8/111 |
| 4,954,138 | 9/1990 | Butcher . | |
| 5,013,327 | 5/1991 | Wahle et al. | 8/125 |
| 5,114,620 | 5/1992 | Garvey et al. | 510/397 |
| 5,512,060 | 4/1996 | Fornelli et al. | 8/115.52 |

FOREIGN PATENT DOCUMENTS

| | | |
|---|---|---|
| 9203893 A | 4/1993 | Brazil . |
| 0275432 | 7/1988 | European Pat. Off. . |
| 06235175 | 8/1994 | Japan . |
| 22 33 352 | 1/1991 | United Kingdom . |
| 2258655 | 2/1993 | United Kingdom . |
| WO 90/07569 | 7/1990 | WIPO . |

OTHER PUBLICATIONS

Derwent Abstract of BR 9203893, Abstract #93=205786/26, 4–1993.

*Primary Examiner*—Alan Diamond
*Attorney, Agent, or Firm*—Hesna J. Pfeiffer

[57] ABSTRACT

Finishing agent for the finishing treatment of textile fiber materials of natural origin and/or of regenerated cellulose and/or of synthetic fibers, containing i) a fine-grained, inorganic abrasive, ii) an anionic or non-ionic, low-foaming wetting agent, and iii) a non-ionic carrier, and the use of this finishing agent in the finishing treatment of textile fiber materials, whereby special surface effects are obtained.

6 Claims, No Drawings

FINISHING OF TEXTILE FIBRE MATERIALS

This is a continuation of application Ser. No. 08/382,334, filed Feb. 1, 1995 now abandoned.

The invention relates to a finishing agent for the finishing treatment of textile fibre materials of natural origin and/or of regenerated cellulose and/or of synthetic fibres, comprising i) 10–90% by weight, preferably 40–60%, of a fine-grained, inorganic abrasive, ii) 5–50% by weight, preferably 15–30%, of an anionic or non-ionic, low-foaming wetting agent, and iii) 5–50% by weight, preferably 15–30%, of a carrier.

The finishing agent preferably further contains 0.1–20%, preferably 1–10%, of a sequestering agent and/or 0.01–10%, preferably 0.1–5% of a solubilising agent.

Preferably the finishing agent as defined above further comprises 0.1–10% by weight, preferably 1–5% of a specific enzyme preparation, optionally containing a micro-encapsulated or immobilized enzyme.

The carrier can e.g. be a thickening agent containing polyvinyl alcohol, alginate, carboxymethylcellulose or a non-ionic softener, preferably the carrier is a non-ionic softener.

The invention also comprises a process for the finishing treatment of textile fibre materials of natural origin and/or of regenerated cellulose and/or of synthetic fibres, characterized in that the textile fibre materials are treated with a universal wetting, dispersing and washing agent and with the finishing agent defined above, and optionally with a specific enzyme preparation, at a temperature of 20° to 100° C. and at pH 3–9, in a machine that produces strong turbulence. This process is preferably carried out at 60°–70° C. and at pH 5–8.5, preferably at pH 5–7.

The invention further includes a multi-phase process for the finishing treatment of textile fibre materials of natural origin and/or of regenerated cellulose and/or of synthetic fibres, characterized in that these textile fibre materials are subjected to the following treatment steps a) are pre-treated with an enzyme-tolerant, non-ionic to slightly anionic, universal wetting, dispersing and washing agent, and optionally with an amylase and a protonizing sequestering agent, b) are treated with a caustificating or mercerizing solution, which optionally contains a wetting agent that is resistant towards strong lyes, and a sequestering agent, in order to swell the fibres, and are then washed for neutralisation purposes, c) are optionally treated with a specific enzyme preparation in a neutral to slightly acidic bath, d) are optionally dyed, e) are treated with a universal wetting, dispersing and washing agent and with the finishing agent as defined above, and optionally with a specific enzyme preparation, at 60°–70° C., pH 5–8.5, preferably pH 5–7, in a machine that produces strong turbulence, and finally f) are finished, optionally in the presence of the protonizing sequestering agent as in stage a), with a shear-resistant silicone after-treatment agent (preferably in the form of an aqueous emulsion), wherein treatments a), c) and d) are optional and treatments c), d) and e) may be carried out in any order after b) and prior to f). The expression "textile fibre materials of natural origin" is understood to include cotton, linen, wool, silk, etc.

The finishing agent according to the invention may be used for the finishing of textile fibre materials, whereby interaction of the components between themselves and with the textile fibres effects a change in the surface of the textile fibres through controlled erosion.

By varying the relative proportions of the finishing agent's components, the stages of the process and the conditions of the process, e.g. time, temperature, concentrations, and/or the apparatus employed, as well as the after-treatment, various effects are obtained on the textile fibre material through changes of the surface, e.g. opalescence, silk aspect, "vagabond", "snow wash", "distress look", "blanchissure", "peach skin", "angel skin" and "dinosaur skin" effects, or the material appears to be faded, worn, aged, fluffed up, velvety or rubbery. Common fibres may be given a high-quality finish by the finishing agent of the present invention, so that e.g. regenerated cellulose fibre materials resemble silk, and linen, jute, ramie or hemp resemble cotton, and coarse wool resembles cashmere, and silk resembles "angel skin".

The expression "specific enzyme preparation" is understood to mean an enzyme that is specific for the textile substrate to be used, i.e. for cellulosic fibres and for regenerated cellulosic fibres cellulase-containing preparations are used, and for animal fibres, e.g. wool and silk, protease-containing preparations are used. If only synthetic textile fibres are used, the various enzyme treatment steps may be omitted. In the case of mixed fibres, the enzymes that are specific for the natural and cellulose-regenerate fibres are used.

If a finishing agent is employed, which additionally contains an enzyme preparation (free, micro-encapsulated or immobilised enzyme), in the process according to the invention [in stage e) of the multi-stage process], the separate addition of an enzyme may be omitted.

The material for the micro-capsule of the micro-encapsulated enzyme may be, for example, a polymer that is insoluble in water, in which the enzyme is embedded, optionally together with additional stabilizing substances, whereby the enzyme is protected from heat and moisture during storage and is only slowly released by abrasion in the process of the invention. One preferred micro-encapsulated enzyme is, for example, the cellulase Indiage 77G micro-encapsulated in ENZOGUARD (Indiage 77G and ENZOGUARD are trade names of Genencor International).

By the expression "fine-grained inorganic abrasive" is generally understood an abrasive having particle sizes ranging from 10 μm to 500 μm, preferably 50 μm to 300 μm, with a density of 0.5 to 3, preferably 1, and a hardness of 2 to 10 Mohs. The abrasive should be free from iron oxide, since this soils the textile fibre material, and should preferably not form dust. Preferred abrasives include particles of sand, quartz, flint, diatomaceous earth and pumice, most preferably pumice and quartz particles.

The finishing agent according to the invention is preferably pasty, whereby the fine-grained inorganic abrasive erodes the textile surface and the wetting agent reduces the surface tension of the textile fibre material, so that the abrasive may more easily attack the surface of the textile. The carrier ensures that rubbing by the abrasive on the textile surface is flexible and even, and the action is reinforced by briefly preventing the abrasive from leaving the textile material. Preferred are anionic, low-foaming wetting agents consisting e.g. of a mixture of paraffin-sulphonic acid sodium salt, tri(butoxyethyl)phosphate and silicone-antifoaming agent in aqueous solution. Preferred non-ionic, low-foaming wetting agents (e.g. "Sandoclean" PC liq.) are similarly known. Preferred carriers are non-ionic softeners such as, e.g., a stearic acid/diethanolamine condensate 2:1 in aqueous solution.

In order to achieve the desired effects, it is essential that treatment of the textile fibre material be carried out in a machine which produces high turbulence or circulation. It does not matter whether it is the goods, the bath or both the goods and the bath which circulate. Examples of apparatus which can produce this turbulence include a drum washing machine, a jet and an overflow. For treatment with the finishing agent of the present invention, it is preferable to use the AIRO 1000 machine from Biancalani, in which the textile material circulates at a rate of up to 1000 n/min due to a strong current of air. This air transport system reduces the formation of folds in the goods. Similarly preferred is the use of the turbulence generating machines "Rototumbler" of Thies, "Zephyr" of ICBT, Lyon, or "Combisoft" of MAT, Italy.

The addition of an anionic sequestering agent serves to form a complex in the material where necessary (especially in the case of regenerated cellulose) of heavy metal ions (especially copper) that are present, and to remove all remaining impurities. Preferred sequestering agents that are appropriate for this purpose are e.g. solutions containing Na gluconate.

The addition of a solubilising agent serves to reduce the viscosity of the paste, so that it can be better handled. Preferred solubilising agents are e.g. diethylene glycol monobutylether, diethylene glycol or hexylene glycol.

The effects that are obtained by the above-described process through treatment with enzymes, with wetting, dispersing and washing agents and with the finishing agent of the present invention, or optionally with wetting, dispersing and washing agents and with the finishing agent of the present invention which additionally contains an enzyme preparation, may be enhanced if the textile fibre material is treated by the above-described multi-phase process.

The treatment liquor for the process according to the invention generally contains 1 to 5% of the enzyme preparation (e.g. "Bactosol CA" liquid), based on the weight of the textile goods, 0.5 ml/l of the wetting, dispersing and washing agent (e.g. "Sandoclean PC", "Sandozin NIN" or "Sandozin NA") and 1 to 5% of the finishing agent of the present invention, based on the weight of the textile goods.

In the multi-phase process, step a) of the treatment according to the invention serves to remove natural size (starch) with an amylase, and synthetic sizes (CMC= carboxymethyl cellulose, PVA=polyvinyl alcohol, PAC= polyacrylate) and to form a complex where necessary in the material (especially regenerated cellulose) of the heavy metal ions (especially copper) that are present, and also to remove all remaining impurities which might be troublesome in the enzymatic treatment to follow later. Preferred complexing agents that are appropriate for this purpose are e.g. the complexing agents known from DE-OS 452 08 106, consisting of a mixture of citric acid and an alkali or ammonium salt of a glucocarboxylic acid and optionally a small quantity of a mineral acid in aqueous solution.

In order to swell the fibres [treatment step b)], a strongly alkaline, aqueous, caustic potash solution is used, which contains a potassium or sodium silicate, a gluco-carboxylic acid, a sulphonated fatty acid amide and preferably a wetting agent, as described e.g. in EP 220 170 B1. By using adjuvants containing caustic potash solution, which effect swelling of the fibres, there is far less shrinkage of the treated cellulosic fibre materials than when using alkaline treatment baths containing caustic soda. However, mercerization may also take place in the conventional manner, using caustic soda solution.

In treatment step c), the surface of the textile fibre material is attacked by the enzyme, whereby the handle of the textile fibre material is changed and special effects are obtained with any subsequent dyeing step.

After treatment step c), the material to be treated according to the invention is preferably dyed by conventional methods, e.g. an exhaust or padding process, or it may be printed by conventional processes, in treatment step d). Depending on the desired appearance/properties of the completed material, dyeing may be carried out with various types of dyestuffs. If a dyeing with good fastness is required, dyeing is effected with vat dyes. An (artificially produced) aged or faded effect is obtained in particular with pigment (-like) dyes (e.g. disperse dyes). Between these extremes, there are, in order of decreasing fastness, dyeings made with reactive dyes, fixed direct dyes, sulphur dyes and unfixed direct dyes.

In treatment step e), an essential element of this invention, the surface of the textile fibre material is further attacked by the abrasive and optionally by further enzyme treatment, or when using synthetic textile fibre material it is attacked for the first time, whereby the above-mentioned effects are obtained.

In the last treatment step f), the soft handle of the textile fibre material is improved through the use of a shear-resistant silicone elastomer.

The treatment liquors generally contain in stage a) 1 to 5 ml, preferably about 2 ml, of a preparation of a protonizing sequestering agent according to DE-OS 42 08 106 (e.g. containing 5–40% citric acid, 5–40% sodium gluconate, up to 10% hydrochloric acid, the remainder water to make up 100%), 1–5 ml of an enzyme-tolerant wetting, dispersing and washing agent (e.g. "Sandoclean PC") and optionally up to 2 ml of the said amylase-desizing agent (e.g. "Bactosol MTN" liquid) per liter of treatment liquor, the substrate-to-liquor ratio is about 1:5 to 1:20, preferably about 1:10;

in stage b) about 10 to 200 ml of 50% caustic potash solution, 1 to 5 ml, preferably about 2 ml, of a preparation according to EP 220 170 (containing 18 to 25% KOH, 6.5 to 8.5% potassium or sodium silicate solution 30% , 2 to 4% sodium gluconate/sulphonated fatty acid amine and about 0.05 to 0.1 % wetting agent, the remainder water to make up 100%) or 3°–36°Bé NaOH and 0.5 to 2 ml of an above-mentioned preparation according to DE-OS 42 08 106 and optionally 2 ml of a wetting, dispersing and washing agent (e.g. "Sandoclean PC") per liter of treatment liquor, and the goods-to-liquor ratio is again about 1:5 to 1:20, preferably about 1:10;

in stage c) about 1 to 10%, preferably 2 to 5%, based on the weight of the substrate, of enzyme preparation (e.g. "Bactosol CA" liquid for cellulosic fibres, "Bactosol WO" liquid for wool and "Bactosol SI" liquid, conc. for silk fibres) in a liquor (goods-to-liquor ratio again about 1:5 to 1:20, preferably about 1:10) which was set at pH 5–6 with a protonizing agent according to DE-OS 42 08 106;

in stage d) conventional dye liquors, depending on the type of substrate and type of dyestuff;

in stage e) about 1 to 5%, based on the weight of the textile goods, of enzyme preparation (e.g. "Bactosol CA" liquid, "Bactosol WO" liquid or "Bactosol SI" liquid, conc.), 0.5 ml/l of the wetting, dispersing and washing agent (e.g. "Sandoclean PC") and 1 to 5%, based on the weight of the textile goods, of the finishing agent of the present invention, at an acidic to alkaline pH, preferably pH 5 to 8.5, more preferably pH 5–7, and in stage f) about 0.5 to 5%, preferably 1 to 3%, based on the weight of the substrate, of a silicone after-treatment agent, preferably in aqueous emulsion, whereby the liquor (goods-to-liquor ratio again about 1:5 to 1:20, preferably about 1:10) is again set at pH 5 to 6 with the preparation according to DE-OS 42 08 106.

The treatment times and temperatures are generally as follows:

stage a) 15 to 40, preferably 20 to 30 minutes at 50° to 80° C., preferably 60° to 70° C.;

stage b) 10 to 50, preferably 20 to 30 minutes at 40° to 90° C., preferably 50° to 80° C.; stage c) 20 to 150, preferably 30 to 120 minutes at 50° to 75° C., preferably about 60° C.;

stage d) depends on the dyestuff and dyeing process employed;

stage e) 20 to 150, preferably 30 to 120 minutes at 20° to 100° C., preferably at 60° C. to 70° C. and stage f) 15 to 45, preferably 20 to 30 minutes at 30° to 60° C., preferably about 40° C.;

After each operation, the substrate is rinsed/washed, and if necessary, neutralized.

The following examples serve to illustrate the invention. In the examples, the parts are by weight and the % are percentages of weight of the dry textile goods; the temperatures are given in degrees celsius.

EXAMPLE 1

Preparation of the finishing agent

In order to obtain 100 parts of the finishing agent of the present invention, 40 parts of quartz particles with sizes varying from 50 to 300 μm and with a density of 1, 25 parts of an aqueous solution containing 55 parts of paraffin-sulphonic acid sodium salt, 16.5 parts of tri(butoxyethyl) phosphate and 6 parts of a silicone-antifoaming agent ("VP 1169 Wacker"), 24 parts of an aqueous solution containing 14 parts of a stearic acid/diethanolamine condensate 2:1, 5 parts of a micro-encapsulated cellulase ("INDIAGE 77 G" from Genencor), 5 parts of sodium gluconate and 1 part of diethylene glycol monobutylether are worked together to form a pourable paste.

EXAMPLE 2

"Peach skin" effect on 100% CUPRO

The following of the above-mentioned stages are carried out to obtain the desired effect:

(a) A fabric of copper-regenerate cellulose, weight 80 g/m$^2$, is treated with high turbulence at 70° C. for about 30 minutes in liquor, goods-to-liquor ratio 1:8, containing per liter 2 ml of an aqueous solution containing 25 parts of sodium gluconate and 25 parts of citric acid monohydrate, 2 ml of an enzyme-tolerant wetting, dispersing and washing agent based on ethoxylated fatty alcohols ("Sandoclean PC" liquid) and 2 ml of α-amylase desizing agent ("Bactosol MTN" liquid) , then rinsed, (b) it is the n treated with strong turbulence at ca. 70° C. for ca. 60 minutes in another aqueous liquor (goods-to-liquor ratio 1:8) containing per liter ca. 3°–6° Bé KOH (100%), 2 ml of a caustification agent containing an anionic wetting and lubricating agent for stenter frame mercerization, a wetting and dispersing agent based on castor oil, a sequestering agent containing sodium gluconate and a sequestering agent based on diethylenetriaminepenta(methylene-phosphonate) ("Sandoflex A" liquid) and 2 ml of an aqueous solution containing 23 parts of the sodium salt of diethylenetriaminepenta(methylene-phosphonate), then given a cold rinse, neutralized and rinsed again, then afterwards (d) it is dyed on a jet with a direct dye, then (e) it is treated with vigorous turbulence at 60° C. for 40 minutes in liquor (goods-to-liquor ratio again 1:8) containing ca. 3% of an enzyme having specific activity on cellulose substrate ("Bactosol CA" liquid) and 3% of the finishing agent of example 1, the liquor having been set at pH 5, then rinsed and afterwards (f) it is treated with vigorous turbulence at 40° C. for ca. 20 minutes in liquor, which has been set at pH 5 (goods-to-liquor ratio 1:8) and contains 1.5% of a shearing-resistant finishing agent based on a silicone elastomer ("Sandoperm MEJ" liquid) and 2% of an aqueous solution containing 14 parts of a stearic acid/diethanolamine condensate 2:1, and finally, after thorough rinsing, it is dried at 130° C. with circulation of the goods at ca. 1000 m/min. A deep dyed fabric with a peach-skin-like appearance and very soft handle is thus obtained.

All treatments with strong turbulence are carried out in an "AIRO 1000" from Biancalani.

EXAMPLE 3

"Peach skin" and opalescence effect on CUPRO

In order to obtain these effects, the copper-regenerate cellulose is treated as described in example 2, with the difference that the mercerization stage (b) is carried out with strong turbulence at ca. 70° C. for ca. 60 minutes in liquor containing per liter 2 ml of an enzyme-tolerant wetting, dispersing and washing agent ("Sandoclean PC" liquid), 2 ml of an aqueous solution containing 23 parts of the sodium salt of diethylenetriaminepenta(methylene-phosphonate) and 75 ml of NaOH (36° Bé), and that an additional finishing step is added between stages (d) and (e), in which the material is treated for 2 minutes at 160° C. on a stenter in liquor containing per liter 10 g of a shearing-resistant finishing agent based on a silicone elastomer ("Sandoperm MEJ" liquid), 40 g of a polyurethane crease-proofing finishing agent ("Finish PU liquid") and 1.5 g of a polymerization catalyst for "Finish PU liquid".

EXAMPLE 4

"Distress Look" and faded appearance on cotton or linen

The following of the above-mentioned stages are carried out to obtain the desired appearance:

(a) A cotton or linen fabric is treated in liquor, goods-to-liquor ratio 1:8, containing per liter 5 ml of an enzyme-tolerant wetting, dispersing and washing agent based on ethoxylated fatty alcohols ("Sandoclean PC" liquid) and 5 ml of (α-amylase desizing agent ("Bactosol MTN" liquid) in the "pad-batch" process, whereby padding is effected at 60°–70° C., the fabric is left for 4 hours at room temperature and then rinsed, and afterwards (b) it is mercerized in a mercerizing machine in liquor containing per liter 2 ml of an enzyme-tolerant wetting, dispersing and washing agent ("Sandoclean PC"

liquid), 2 ml of an aqueous solution containing 23 parts of the sodium salt of diethylenetriaminepenta (methylene-phosphonate) and 26° Bé NaOH, then rinsed, and afterwards bleached with peroxide by a classic process and washed, then (d) it is dyed on a jet with a direct dye at 130° C., then (e) it is treated with vigorous turbulence for 60 minutes at 60° C. in liquor (goods-to-liquor ratio again 1:8) containing ca. 3% of an enzyme having specific activity on cellulose substrate ("Bactosol CA" liquid) and 5% of the finishing agent of example 1, which has been set at pH 5, and rinsed, and afterwards (f) it is treated with vigorous turbulence for ca. 20 minutes at 40° C. in liquor (goods-to-liquor ratio 1:8), which has been set at pH 5 and contains 1.5% of a shearing-resistant finishing agent based on a silicone elastomer ("Sandoperm MEJ liquid") and 2% of an aqueous solution containing 14 parts of a stearic acid/diethanolamine condensate 2:1, and finally, after thorough rinsing, it is dried at 130° C. with circulation of the goods at ca. 1000 m/min. A deep dyed fabric with a "Distress Look" and faded appearance and very soft handle is obtained.

All treatments with strong turbulence are carried out in an "AIRO 1000" from Biancalani.

EXAMPLE 5

"Dinosaur skin appearance"

In order to induce this appearance, a cotton fabric coated with synthetic resin is treated with strong turbulence in the "AIRO 1000" for 30 minutes at 60° C. in liquor (goods-to-liquor ratio 1:8) containing 3% of finishing agent from example 1, and after thorough rinsing, dried for 45–60 minutes in the same machine at 100°–120° C. with circulation of the goods at ca. 1000 m/min.

EXAMPLE 6

"Angel skin" and "blanchissure" appearance on silk

The following of the above-mentioned stages are carried out to obtain the desired effect:

(a) A silk fabric is treated with strong turbulence for about 30 minutes at 60° C. in liquor, goods-to-liquor ratio 1:8, containing per liter 2 ml of an aqueous solution containing 25 parts of sodium gluconate and 25 parts of citric acid monohydrate, 2 ml of an enzyme-tolerant wetting, dispersing and washing agent based on ethoxylated fatty alcohols ("Sandoclean PC" liquid), then rinsed, (d) it is dyed according to a classic process with a metal, acid or reactive dye, then washed and (e) it is treated with vigorous turbulence for 30 minutes at 60° C. in liquor (goods-to-liquor ratio again 1:8) containing ca. 3% of an enzyme having specific activity on silk substrates ("Bactosol SI" liquid) and 3% of the finishing agent from example 1, which has been set at pH 8.5 with sodium carbonate, then rinsed and (f) it is treated with vigorous turbulence for ca. 20 minutes at 40° C. in liquor (goods-to-liquor ratio 1:8), which has been set at pH 5 and contains 2% of a shearing-resistant finishing agent based on a silicone elastomer ("Sandoperm MEJ" liquid) and 2% of an aqueous solution containing 14 parts of a stearic acid/diethanolamine condensate 2:1, and finally, after thorough rinsing, it is dried at 130° C. with circulation of the goods at ca. 1000 m/min. A deep dyed fabric with an "Angel skin" and powdery-white appearance and a very soft handle is obtained.

All treatments with strong turbulence are carried out in an "AIRO 1000" from Biancalani.

EXAMPLE 7

"Blanchissure" and silk appearance on polyester

The following stages are carried out in order to obtain the above-mentioned appearance (b) A polyester fabric is treated with strong turbulence for 30–60 minutes at 60°–70° C. in liquor (goods-to-liquor ratio 1:8) containing per liter 2 ml of a wetting, dispersing and washing agent ("Sandoclean PC" liquid), 2 ml of an aqueous solution containing 23 parts of the sodium salt of diethylenetriaminepenta(methylene-phosphonate) and 40 ml of a NaOH 36° Bésolution, then rinsed and afterwards (d) it is dyed on a jet with a disperse dye, then (e) it is treated with vigorous turbulence for 30–45 minutes at 60° C. in liquor (goods-to-liquor ratio again 1:8) containing 3–5% of the finishing agent from example 1, which has been set at pH 5, then rinsed and afterwards (f) it is treated with vigorous turbulence for ca. 20 minutes at 40° C. in liquor (goods-to-liquor ratio 1:8), which has been set at pH 5 and contains 1.5% of a shearing-resistant finishing agent based on a silicone elastomer ("Sandoperm MEJ" liquid) and 2% of an aqueous solution containing 14 parts of a stearic acid/diethanolamine condensate 2:1, and finally, after thorough rinsing, it is dried for 30 minutes at 120° C. with circulation of the goods at ca. 1000 m/min. A deep dyed fabric with a powdery-white, silky appearance and a very soft handle is obtained.

All treatments with strong turbulence are carried out in an "AIRO 1000" from Biancalani.

I claim:

1. Finishing agent for the finishing treatment of textile materials comprising i) 10–90% by weight of a fine-grained, quartz abrasive, ii) 5–50% by weight of an anionic or non-ionic wetting agent, iii) 5–50% by weight of a non-ionic softener, iv) 0.1–10% by weight of a specific enzyme preparation, optionally containing micro-encapsulated or immobilized enzymes; and optionally either one or both of the following:

v) 0.1–20% by weight of a sequestering agent, and vi) 0.001–10% by weight of a solubilizing agent, the total of the percentages being 100%.

2. Finishing agent of claim 1, in which 1–10% by weight of the sequestering agent is employed.

3. Finishing agent of claim 1, in which 0.1–5% of the solubilizing agent is employed.

4. The process for the finishing treatment of textile material which comprises mixing said textile material in a treatment liquor at a ratio of textile: liquor of 1:8, the liquor containing 1–5% by weight of the finishing agent of claim 1, based on the weight of the textile material, at 20°–100° C., and pH 3–9, in a machine that produces strong turbulence, for from about 20 to 150 minutes.

5. The process of claim 4 in which the pH is 5–8.5, and the temperature is 60°–70° C.

6. The process of claim 5 in which the pH is 5–7.

* * * * *